US008950474B2

(12) United States Patent
Kekarainen

(10) Patent No.: US 8,950,474 B2
(45) Date of Patent: Feb. 10, 2015

(54) SUBSEA CAP

(75) Inventor: Jarmo Kekarainen, Valbo (SE)
(73) Assignee: Aker Subsea AS, Lysaker (NO)

( * ) Notice: Subject to any disclaimer, the term of this patent is extended or adjusted under 35 U.S.C. 154(b) by 235 days.

(21) Appl. No.: 13/519,189

(22) PCT Filed: Jan. 7, 2011

(86) PCT No.: PCT/NO2011/000005
§ 371 (c)(1),
(2), (4) Date: Jun. 26, 2012

(87) PCT Pub. No.: WO2011/084067
PCT Pub. Date: Jul. 14, 2011

(65) Prior Publication Data
US 2012/0285699 A1 Nov. 15, 2012

(30) Foreign Application Priority Data
Jan. 7, 2010 (NO) ..... 20100012

(51) Int. Cl.
*E21B 33/038* (2006.01)
*F16L 55/136* (2006.01)
*E21B 23/01* (2006.01)
*E21B 33/037* (2006.01)

(52) U.S. Cl.
CPC ..... *E21B 33/038* (2013.01); *E21B 23/01* (2013.01); *E21B 33/037* (2013.01)
USPC ..... 166/75.13; 166/368; 166/339; 166/350; 166/365

(58) Field of Classification Search
CPC ..... E21B 33/037
USPC ..... 166/343, 75.13, 356, 368, 339, 360, 166/365
See application file for complete search history.

(56) References Cited

U.S. PATENT DOCUMENTS

| | | | | |
|---|---|---|---|---|
| 3,269,582 | A | 8/1966 | Knocke | |
| 4,651,818 | A | 3/1987 | Johnson et al. | |
| 5,685,372 | A | 11/1997 | Gano | |
| 5,992,526 | A | 11/1999 | Cunningham et al. | |
| 6,793,019 | B2 * | 9/2004 | Rodgers et al. | 166/344 |
| 2008/0210435 | A1 * | 9/2008 | Goonetilleke et al. | 166/368 |
| 2009/0025939 | A1 | 1/2009 | Wenham et al. | |
| 2009/0151958 | A1 | 6/2009 | Gramstad et al. | |

FOREIGN PATENT DOCUMENTS

| | | | |
|---|---|---|---|
| EP | 0687801 | A2 | 12/1995 |
| EP | 1326002 | A2 | 7/2003 |
| GB | 2312455 | A | 10/1997 |
| GB | 2456191 | A | 7/2009 |

OTHER PUBLICATIONS

Bäcknert, Christer, "International Search Report" for PCT/NO2011/000006, as mailed Apr. 19, 2011, 4 pages.
Backnert, Christer, "International Search Report" for PCT/NO2011/000005 as mailed Apr. 19, 2011, 4 pages.

* cited by examiner

*Primary Examiner* — James G Sayre
(74) *Attorney, Agent, or Firm* — Winstead PC

(57) ABSTRACT

A cap having a stinger adapted to be inserted into a bore of a subsea well element. The stinger includes locking means for locking to a profile in said bore, which locking means include a plurality of locking dogs. The locking dogs exhibit a large inclination face and a small inclination face, and are adapted to be actuated in a radial direction by an actuation sleeve. The small inclination face is divided by a slot, in which slot the large inclination face is arranged. A cam is arranged on the actuation sleeve and is adapted to extend into said slot. Alternatively, the small inclination face is divided by a cam arranged on the locking dog, on which the large inclination face is arranged, which cam is adapted to extend into a slot in the actuation sleeve.

6 Claims, 10 Drawing Sheets

SUBSEA CAP

BACKGROUND

1. Field of the Invention

The present invention relates to closing of a bore in a subsea well element. In particular the invention can be employed with a tree cap arranged on the spool of a Xmas tree.

2. History of the Related Art

In the field of oil and gas wells, there is known various ways to seal off a bore of a tubular well element, such as the bore of a Xmas tree. For instance, for subsea wells it is known to arrange a tree cap on top of the Xmas tree spool. The tree cap comprises a stinger which is inserted into the bore of the Xmas tree. In some cases, the Xmas tree spool comprises a production bore and a smaller annulus bore.

Furthermore, some Xmas trees are used for injection wells used to inject fluid into the well bore. The tree cap may then comprise two stingers, of which one is inserted into each of these bores.

It is also known to seal off bores with other bore barrier arrangements, such as plugs which are provided with locking means. European patent application EP 0687801 describes a wireline plug with a metal-to-metal sealing, arranged to be locked in a bore with internal locking grooves. The plug has locking keys (4) arranged to engage with the locking grooves of the bore. An axially movable expander sleeve (3) provides radial movement of the locking keys when it is moved axially. The expander sleeve and the locking keys are provided with sliding faces of different inclination, providing different radial moving distances with respect to the axial moving distance of the expander sleeve, in dependence on the engaged inclined face.

In order to lock the stinger or cap in place, it is known to arrange radially movable dogs, which can engage with inner locking profiles in a bore. To move the dogs radially, it is known to slide a locking sleeve along their inner faces. The locking sleeve typically has an inclined face which moves the dogs radially outward when the sleeve is moved down. In order to move such a locking sleeve down, however, it is common to use a tool which, before moving the sleeve, has to be secured to the well arrangement. This is to prevent the tool from moving upward when forcing the locking sleeve down.

The movement of a locking sleeve is typically provided for by hydraulic pistons in the running tool or by providing linear movement with an ROV actuation device.

SUMMARY

According to the present invention, there is provided a cap comprising a stinger adapted to be inserted into a bore of a subsea well element, said stinger comprising locking means for locking to an internal profile in said bore. The locking means comprises a plurality of locking dogs which exhibit a large inclination face and a small inclination face, and which are adapted to be actuated in a radial direction by an actuation sleeve. According to the invention, the small inclination face is divided by a slot, in which slot the large inclination face is arranged, wherein a cam arranged on the actuation sleeve is adapted to extend into said slot; or the small inclination face is divided by a cam arranged on the locking dog, on which the large inclination face is arranged, which cam is adapted to extend into a slot in the actuation sleeve.

Preferably, a seal arrangement is directly or indirectly connected to the actuation sleeve, in a position adapted to extend further into said bore than the said locking means.

In an advantageous embodiment, the cap is adapted in such way that actuation sleeve can be moved in three moving phases. The first phase comprises moving the locking dogs by engagement with the large inclination faces. The second phase comprises moving the seal arrangement into a region of a seal surface in said bore. The third phase comprises forcing the locking dogs in a further radial direction by engagement with the small inclination face. In this embodiment, the second phase succeeds the first phase. Furthermore, the third phase succeeds the second phase or the third phase takes place simultaneously as the second phase. Thus, in this embodiment the first moving phase can be adapted for a large movement of the locking dogs, without significant resistance, whereas the third phase is adapted for forcing the locking dogs into their locking position with a significant applied force at the end of the moving path of the actuation sleeve.

The cap can advantageously comprise a production bore stinger and an annulus bore stinger, of which two stingers only the production bore stinger is provided with locking means.

The cap can comprise an emergency release sleeve arranged in a position to maintain an emergency release locking arrangement in a locking position. The emergency release sleeve is adapted to be pulled out of said position, and when pulled out of said position, the locking means can be released from locking engagement with said internal profile by pulling the cap. This feature is advantageous in a case where, for some reason, the actuation sleeve cannot be actuated.

Furthermore, the cap can comprise a seal holder, which seal holder exhibits an intermediate section with a convex shape towards the pressure side, encircled by a peripheral part arranged for carrying a seal arrangement for sealing against a seal surface in the bore. The intermediate section is adapted to exert radial force onto the peripheral part when exposed to pressure on its convex side.

Preferably, the cap according to the invention comprises a means for transforming a rotational movement of the rotating actuator into an axial movement of an actuation sleeve. The actuation sleeve is adapted to provide radial movement of the locking means.

The large inclination face has a larger angel to the axial direction than the small inclination face has. Thus, moving the actuation sleeve along the large inclination face results in a longer radial movement of the locking dogs than the small inclination face, in relation to the moved distance of the actuation sleeve. Furthermore, with a given axial force on the actuation sleeve, engagement with the small inclination face will result in a larger radial force on the locking dog than will an engagement with the large inclination face.

Preferably, the small inclination face is divided by a slot in which the large inclination face is arranged. Preferably, a cam structure extending into the slot from the actuation sleeve can engage the large inclination face. This feature yields lateral support of the locking dogs with respect to the actuation sleeve. Alternatively, the small inclination face is divided by a cam structure arranged on the locking dog, on which cam structure the large inclination face is arranged. Preferably, such a cam structure will extend into a corresponding slot on the actuation sleeve.

According to a second aspect of the present invention, there is provided a seal holder for retaining a seal arrangement. The seal arrangement is adapted to seal against a feeing seal surface in a bore of a subsea well element, such as a Xmas tree. The seal holder exhibits an intermediate section encircled by a peripheral part arranged for carrying said seal arrangement. According to the second aspect of the present invention, the intermediate part exhibits a convex shape towards the pressure side, wherein it is adapted to exert radial force onto the peripheral part when exposed to pressure on its convex side.

BRIEF DESCRIPTION OF THE DRAWINGS

Having described the main features of the invention above, a more detailed and non-limiting description of an example embodiment will be given in the following with reference to the drawings, in which.

DETAILED DESCRIPTION

Figure 1:
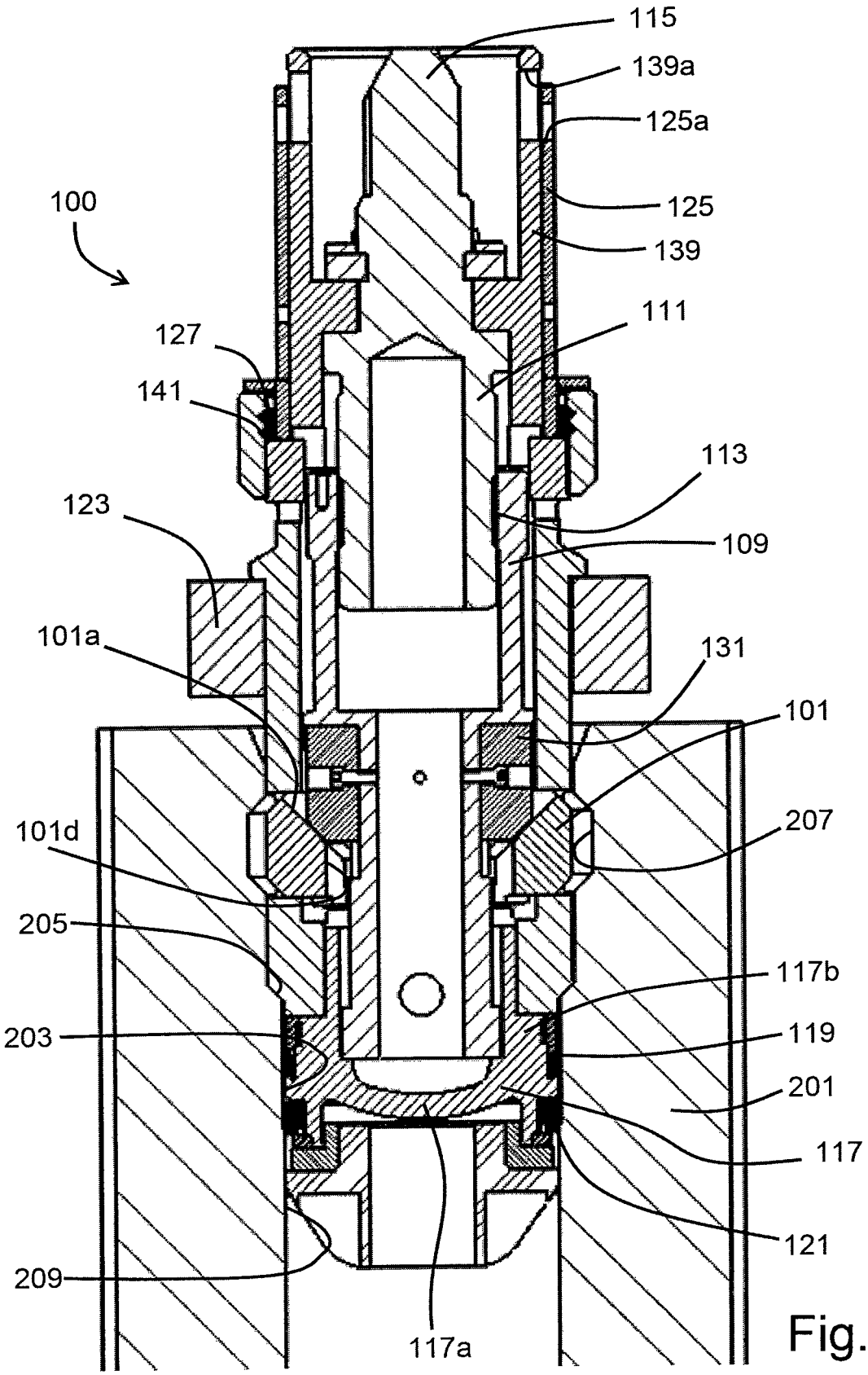
FIG. 1 is a cross section view of a tree cap according to the invention, arranged in the inner bore of a subsea Xmas tree.

FIG. 1 shows a cross section of a tree cap 100 according to the invention. The tree cap 100 is landed in the bore 203 of the tree spool 201 of a subsea Xmas tree. The tree cap 100 rests on a landing shoulder 205 inside the Xmas tree bore 203.

The tree cap 100 has a plurality of locking dogs 101 which are radially movable into a facing internal locking groove 207 of the tree spool 201. The radial movement of the dogs 101 is provided with a downward movement of an actuation sleeve 109. This will be described in more detail below. Furthermore, the actuation sleeve 109 is in a threaded engagement with a rotating actuator 111. That is, a threaded interface 113 between the actuation sleeve 109 and the rotating actuator 111 comprises mutually engaging threads. When the rotating actuator 111 is rotated, the actuation sleeve 109 will move in an axial direction, upwards or downwards in dependence of the direction of rotation. In its upper part, the rotating actuator 111 exhibits a rotation interface 115 adapted for interface with, for instance, a torque tool or an ROV rotation tool (not shown).

To prevent rotation of the tree cap 100 due to rotation of the rotating actuator 111, a pin and hole arrangement (not shown) can preferably be arranged at the top of the tree spool 201. A pin extending from the tree cap 100 into the hole in the tree spool 201 will prevent rotation of the tree cap 100.

In one embodiment (described later with reference to FIG. 9), the tree cap 100 can comprise a stinger 104 for an annulus bore in the tree spool 200. The lower part of the annulus stinger 104 can then advantageously function as an anti rotation means, as it will extend slightly into the annulus bore when the tree cap 100 has landed.

In stead of a threaded interface 113, one could also arrange other means for converting the rotational movement of the rotating actuator 111 to the axial movement of the actuation sleeve 109. Such means can for instance be a roller screw assembly.

At the lower end of the actuation sleeve 109, there is arranged a seal holder 117. Arranged to the seal holder 117 are a polymer seal arrangement 119 and a metal-to-metal seal arrangement 121. Below the position of the seal arrangements 119, 121 shown in FIG. 1, the XT bore 203 exhibits a narrowed portion which constitutes a bore seal surface 209. As will appear from the description below, the seal arrangements 119, 121 will be moved into the area of the seal surface 209 when the activation sleeve 109 is moved downwards. It is not readily seen from FIG. 1, but the bore diameter of the inner bore 203 of the Xmas tree spool 201 is slightly smaller at the seal surface 209 than at the position of the seal arrangements 119, 121 shown in FIG. 1, above said seal surface. Thus, the seal arrangements 119, 121 are actuated, i.e. put into sealing condition, when they enter the region of the seal surface 209.

The tree cap 100 also comprises a retainer plate 123, an emergency release sleeve 125 and emergency release split ring 127. The emergency release arrangements will be described further below.

Figure 2:
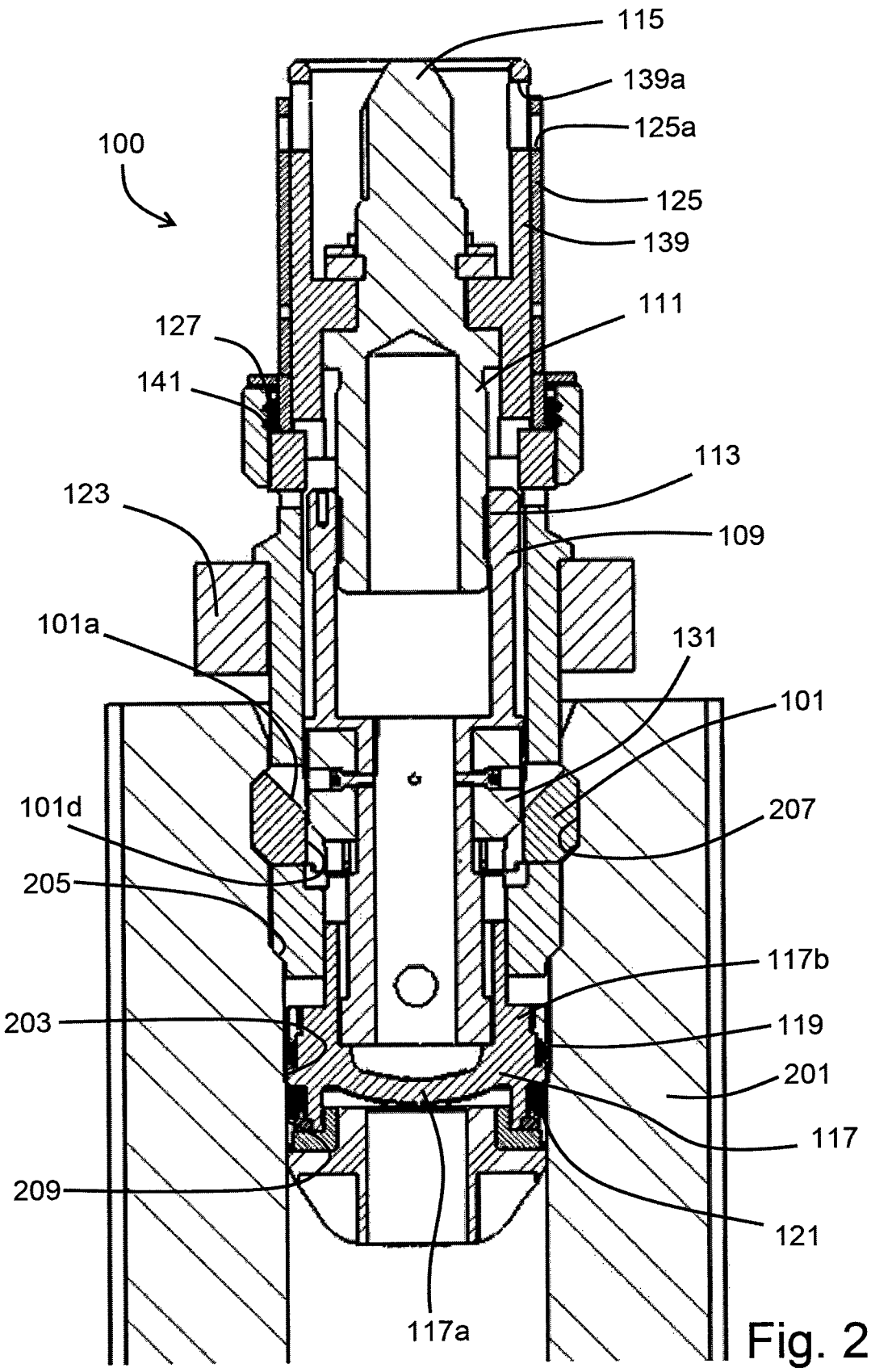
FIG. 2 is a cross section view of the tree cap in FIG. 1, locked to the Xmas tree.

It is now referred to FIG. 2, which is a cross section view corresponding to FIG. 1, but where the actuation sleeve 109 has been moved a first distance axially downwards. This movement has been provided by means of a torque tool (not shown) for rotating the rotating actuator 111 by engagement with the rotation interface 115. In stead of a torque tool, another rotation providing means could be used, preferably a means of an ROV. The locking dogs 101 has now been moved into the facing internal locking profile 207 of the tree spool 201. Furthermore, the metal-to-metal seal arrangement 121 has entered the area of the seal surface 209 of the Xmas tree bore 203. As will be described in greater detail further below, the locking dogs 101 have now been moved by sliding engagement with a plurality of cams 131 arranged on the actuation sleeve 109. The cams 131 have slid against large inclination faces 101*a* of the locking dogs 101. The large inclination faces 101*a* have an inclination of 45 degrees with respect to the axial and radial direction. This ensures a relatively large radial movement of the locking dogs 101 per axial movement of the actuation sleeve 109. Below the large inclination face 101*a* is a vertical face 101*d*.

Figure 3:
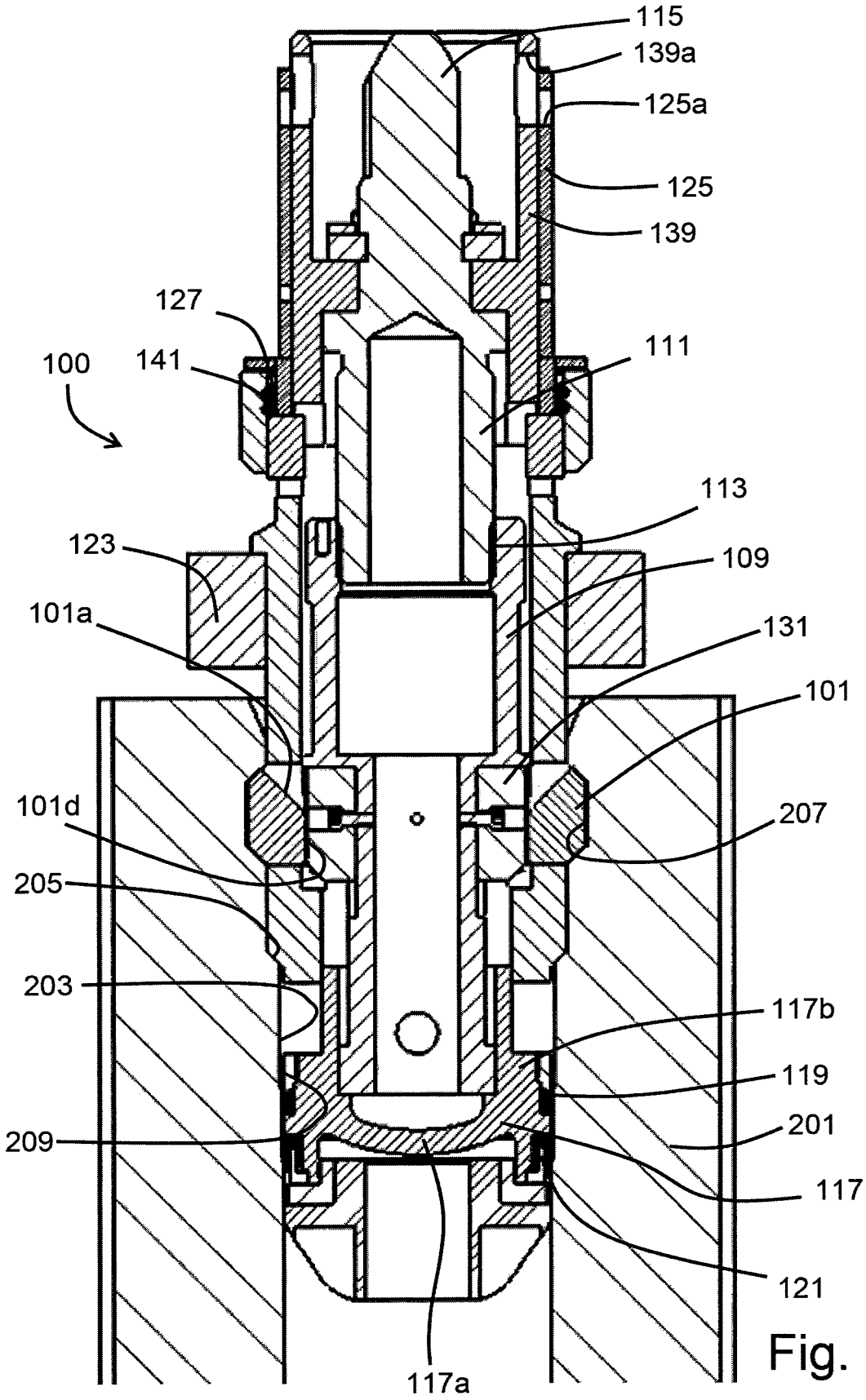
FIG. 3 is a cross section view of the tree cap in FIG. 1 and FIG. 2, locked to the Xmas tree and wherein two seal arrangements are placed in a sealing position.

It is now referred to the FIG. 3, where the actuation sleeve 109 has been moved down to its lowermost position. Both seal arrangements, that is the polymer seal arrangement 119 and the metal-to-metal seal arrangement 121, have now been moved into the area of the seal surface 209 and are thus in a sealing position. Furthermore, the locking dogs 101 have been moved a further small radial distance into the internal locking profile 207. This latter movement will be described now with reference to FIG. 4.

Figure 4:
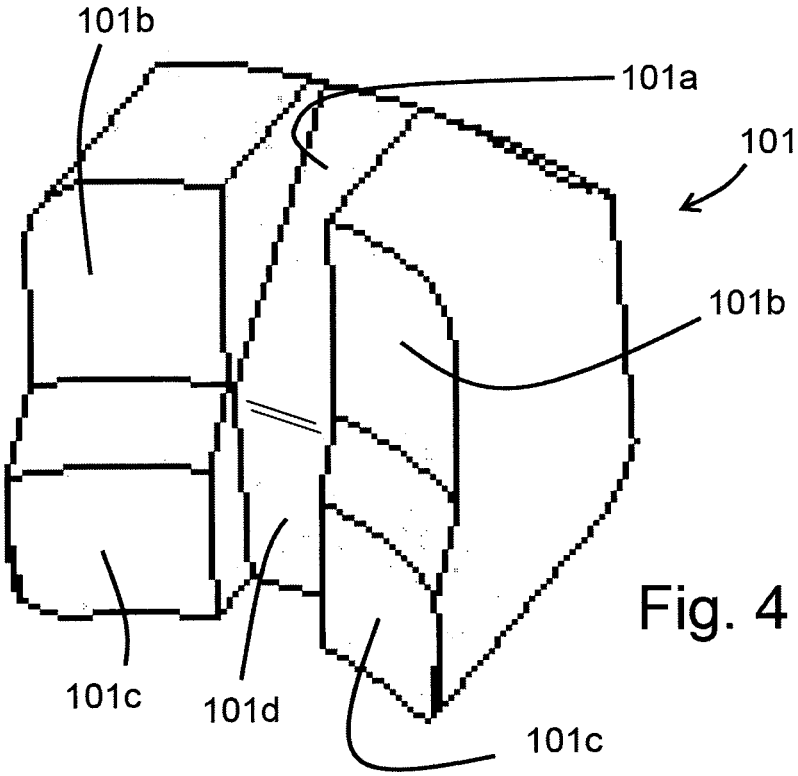
FIG. 4 is a perspective view of a locking dog used to lock the tree cap to the Xmas tree.

FIG. 4 is a perspective view of one of the plurality of locking dogs 101. As indicated above, the locking dog 101 exhibits a large inclination face 101*a* which preferably has an inclination of about 45 degrees with respect to the axial or radial direction. In addition, the locking dog 101 exhibits upper and lower small inclination faces 101*b*, 101*c*, respectively. The upper and lower small inclination faces 101*b*, 101*c* are divided into a left and a right part by a slot, in which said large inclination face 101*a* and vertical face 101*d* are arranged. The cams 131 arranged on the actuation sleeve 109 are adapted to engage with the large inclination face 101*a* within this slot. The slot and cam arrangement provides lateral support to the locking dogs 101.

Figure 5:
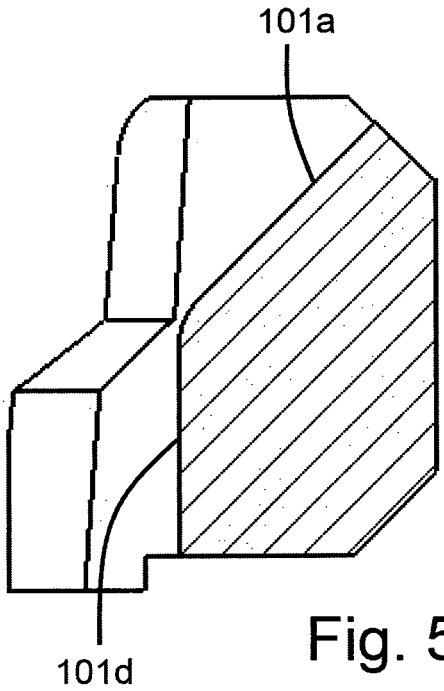
FIG. 5 is a cross section view of the locking dog in FIG. 4.
Figure 6:
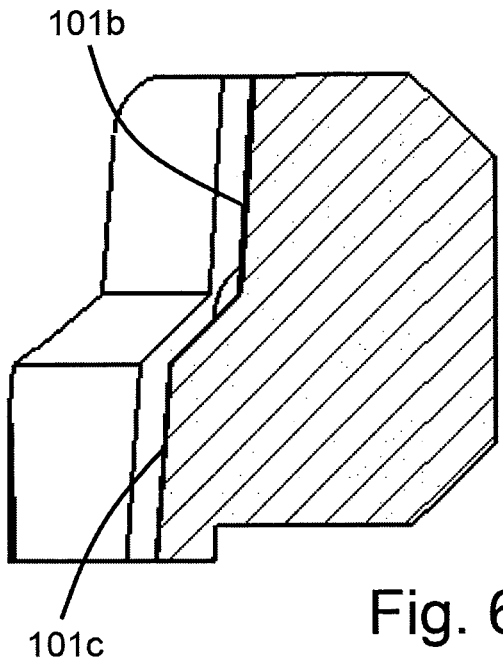
FIG. 6 is another cross section view of the locking dog in FIG. 4.

In order to illustrate the large difference of inclination between the large inclination face 101*a* and the small inclination faces 101*b*, 101*c*, FIG. 5 and FIG. 6 show a cross section view of the locking dog 101 shown in FIG. 4. The cross section of FIG. 5 is through the large inclination face 101*a* and the vertical face 101*d*, whereas the cross section of FIG. 6 is through the upper and lower small inclination faces 101*b*, 101*c*.

A person skilled in the art will appreciate that the locking dogs 101 described herein will be suitable also in connection with other ways of activation, such as hydraulic actuation of an actuation sleeve.

Figure 7:
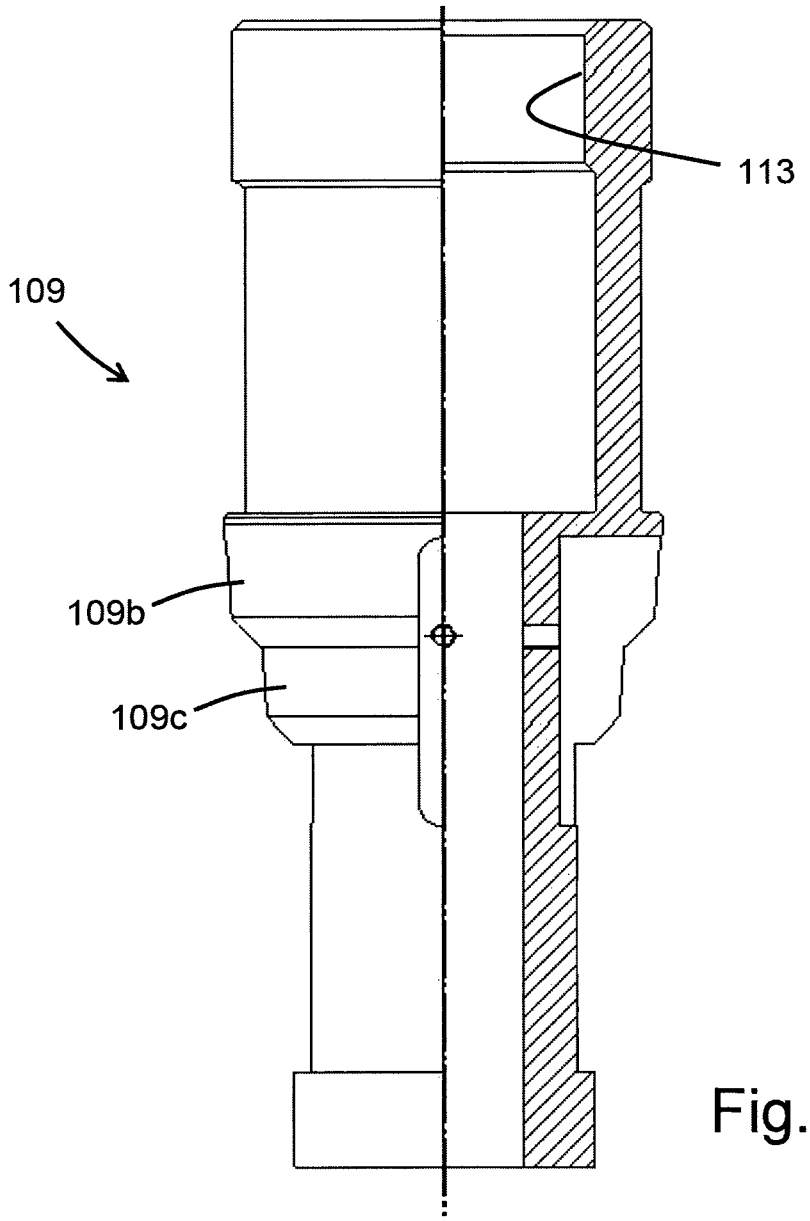
FIG. 7 is a partial cross section view of an actuation sleeve.

Whereas the large inclination face 101*a* of the locking dog 101 engages with the cam 131 arranged to the actuation sleeve 109, the upper and lower small inclination faces 101*b*, 101*c* engage with upper and lower inclined actuation sleeve faces 109*b*, 109*c*, respectively. These faces are shown in FIG. 7, showing the actuation sleeve 109 without the cams 131.

The radial movement of the locking dogs 101, and the axial movement of the actuation sleeve 109, respectively, comprises three phases. A first phase comprises the large distance radial movement of the locking dogs 101 by means of the large inclination faces 101*a*. In this first phase, there is little force needed to move the locking dogs 101 radially. This first phase locks the tree cap 100 to the tree spool 201. This enables the second phase to take place. In the second phase, the seal arrangements 119, 121 are forced into the region of the seal surface 209 of the bore 203. The region of the seal surface 209 has a smaller diameter than what the bore 203 above the seal surface 209 has. In order to be able to force the sealing arrangements into this region, the locking dogs 101 maintain the tree cap 100 in its place despite the vertical forces between the seal arrangements 119, 121 and the tree spool 201 during this second phase. The seals are now inserted into the region of the seal surface 209. In the succeeding third phase, the actuation sleeve 109 is moved further down. During this movement, the upper and lower inclined actuation sleeve faces 109*b*, 109*c*, engages with the facing upper and lower small inclination faces 101*b*, 101*c* of the locking dogs 101. The locking dogs 101 are then only moved a small distance into the locking profile 207, however with a much larger force, as they already may be in contact with the faces of the locking profile 207. This larger force is provided with the much smaller inclination of the upper and lower small inclination faces 101*b*, 101*c*.

It should be noted that in the place of an upper and lower small inclination face, one could also use only one small inclination face. An advantageous inclination angle could be 4 degrees with respect to the axial direction, but also more or even less.

One could also imagine the second and third phases, as described above, to take place simultaneously. That is, moving the locking dogs 101 the last force-requiring distance and forcing the seal arrangements 119, 121 into the seal surface 209 region at the same time.

Figure 8A:
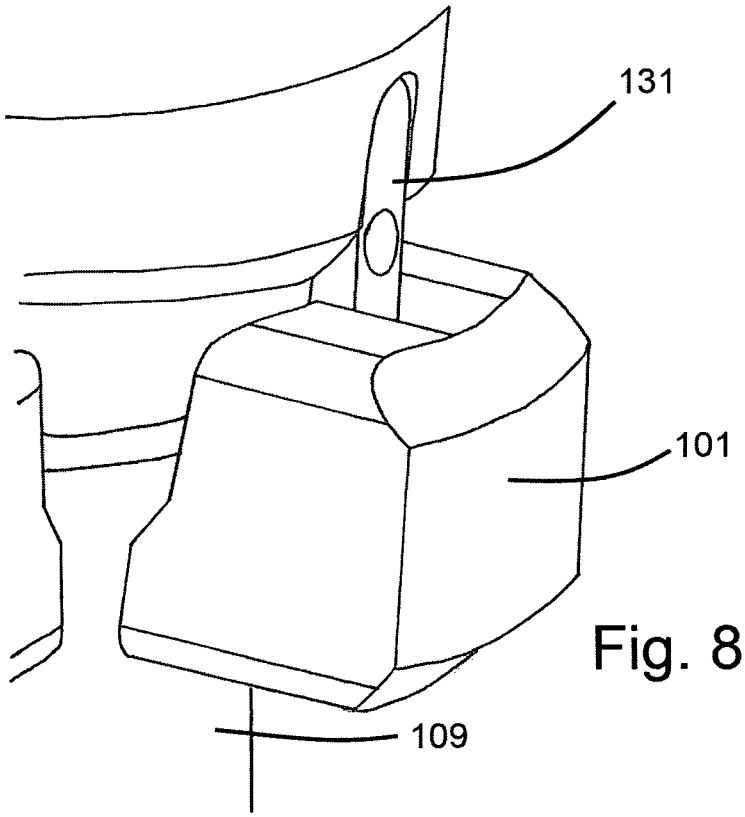
FIG. 8*a* is a perspective view of a part of the actuation sleeve, a cam, and a locking dog.

FIG. 8*a* is a perspective view showing the position of a locking dog 101 with respect to the actuation sleeve 109 and the cam 131. In this position, the movement is in the first phase, i.e. the locking dog 101 is moved by means of the large inclination face 101*a* and the engaging cam 131.

Figure 8B:
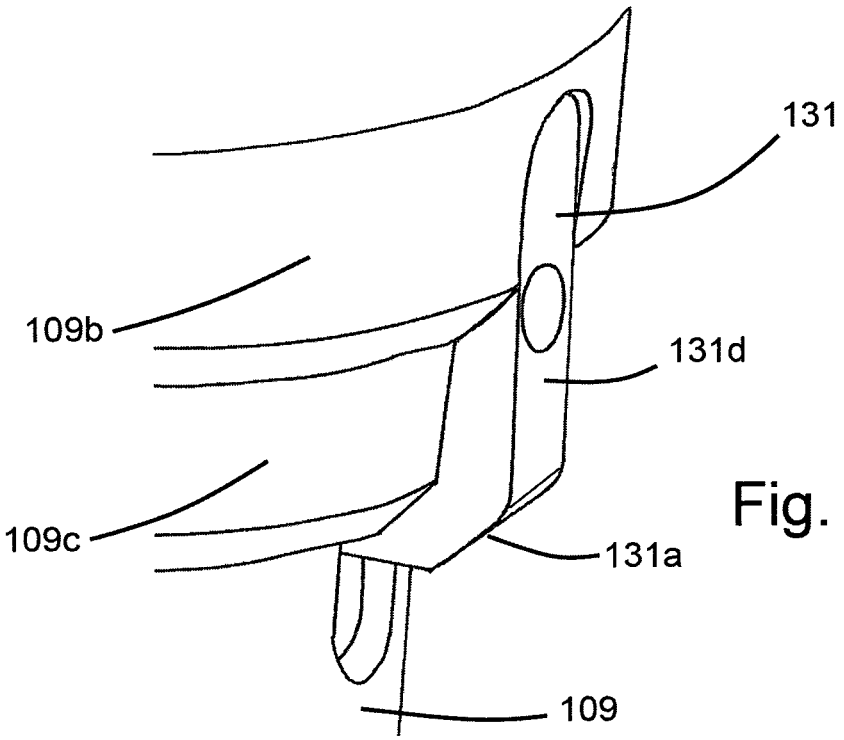
FIG. 8*b* is a perspective view corresponding to FIG. 8*a*, without the locking dog.

FIG. 8*b* is a perspective view of the actuation sleeve 109 with a cam 131 fastened to it. The cam 131 has an inclined face 131*a* arranged to engage with the large inclination face 101*a* of the locking dog 101. Furthermore, it has a vertical face 131*d* arranged to slide along the oppositely arranged vertical face 101*d* during the second phase. The length of the vertical face 131*d*, or the height of the cam 131, respectively, can be chosen by the person skilled in the art to correspond to the required distance of insertion into the region of the seal surface 209 of the bore 203 of the tree spool 201. The cams 131 can be mounted to and dismounted from the actuation sleeve 109, for instance with a simple bol connection.

Figure 9:
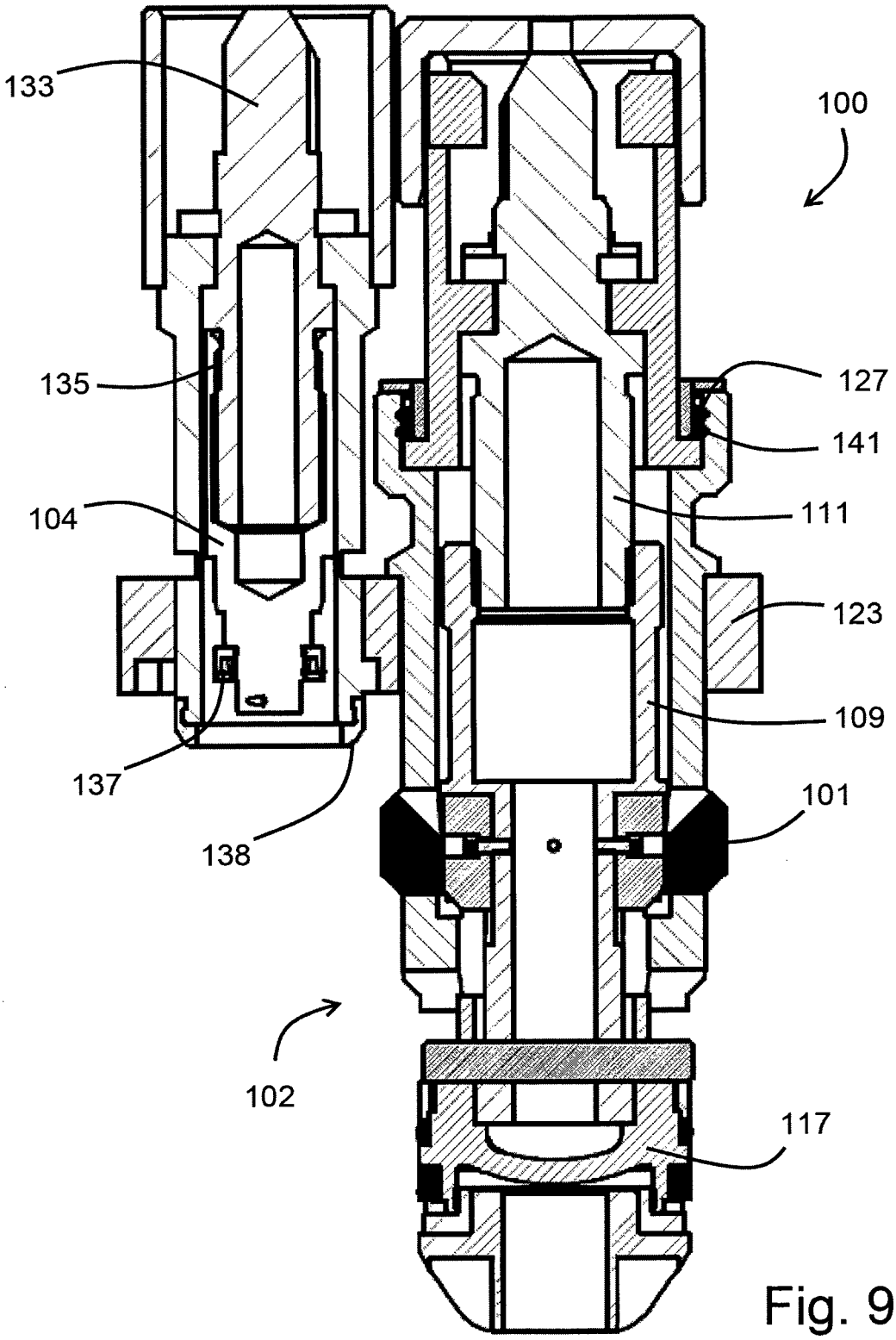
FIG. 9 is a cross section view of a tree cap adapted for a Xmas tree with a production bore and an annulus bore.

The tree cap 100 according to the invention can also comprise two stingers for entering into two separate bores in a Xmas tree. FIG. 9 shows a cross section view of a tree cap 100 adapted for entering a production bore, such as bore 203 in FIG. 1, and an annulus bore (not shown). Thus, the tree cap 100 shown in FIG. 9 has a production bore stinger 102 and an annulus bore stinger 104. Preferably, the annulus bore stinger 104 is entered into the annulus bore by rotational movement of a second rotating actuator 133 which engages with the stinger itself through a threaded interface 135. Thus, by rotating the second rotating actuator 133, the annulus stinger 104 is inserted into the (not shown) annulus bore of the Xmas tree. This should be performed after the production bore stinger 102 has been locked in the bore 203, i.e. the production bore. The annulus stinger 104 does not need to be locked in the annulus bore, since the tree cap 100 itself is locked onto the Xmas tree by means of the locking dogs 101 described above. The retainer plate 123 maintains the two stingers as one tree cap construction. The annulus stinger 104 exhibits a seal arrangement 137 for sealing in the annulus bore.

The tree cap 100 shown in FIG. 9 has an annulus stinger orientation nose 138 which is arranged to extend slightly into the upper part of the annulus bore, thereby aligning the annulus stinger 104 with the axial centre of the annulus bore (not shown). At the same time, the annulus stinger orientation nose 138 will function as an anti rotation means for the tree cap 100.

Figure 10:
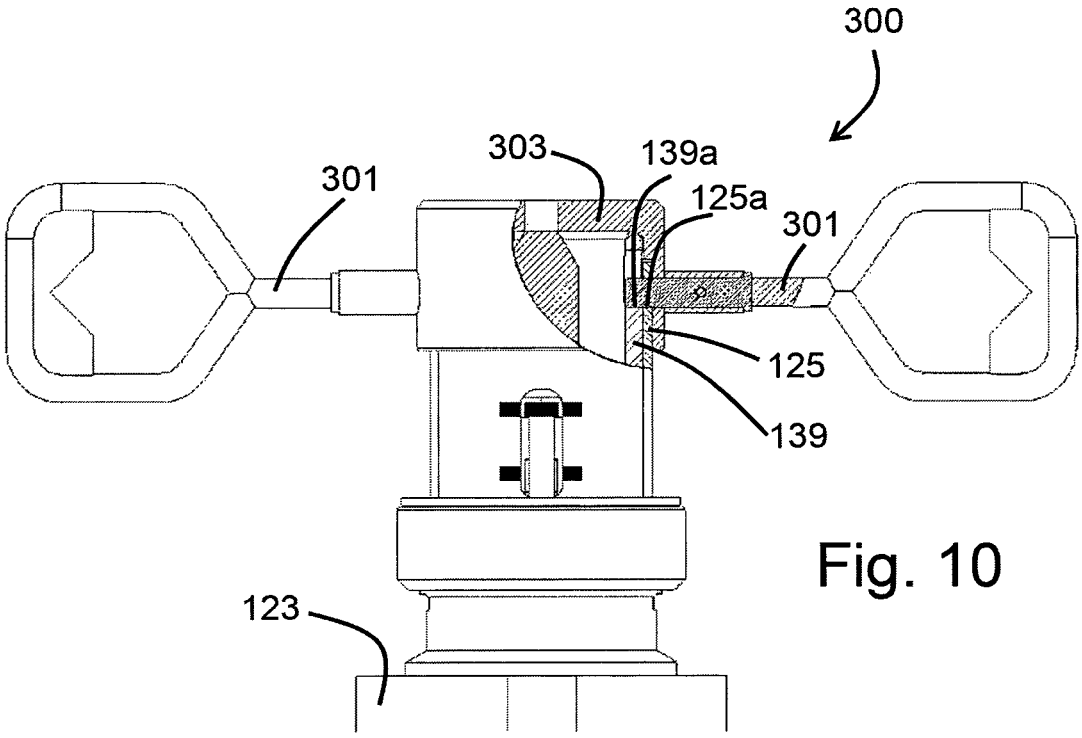
FIG. 10 is a front view of a emergency release tool arranged onto the tree cap.
Figure 11:
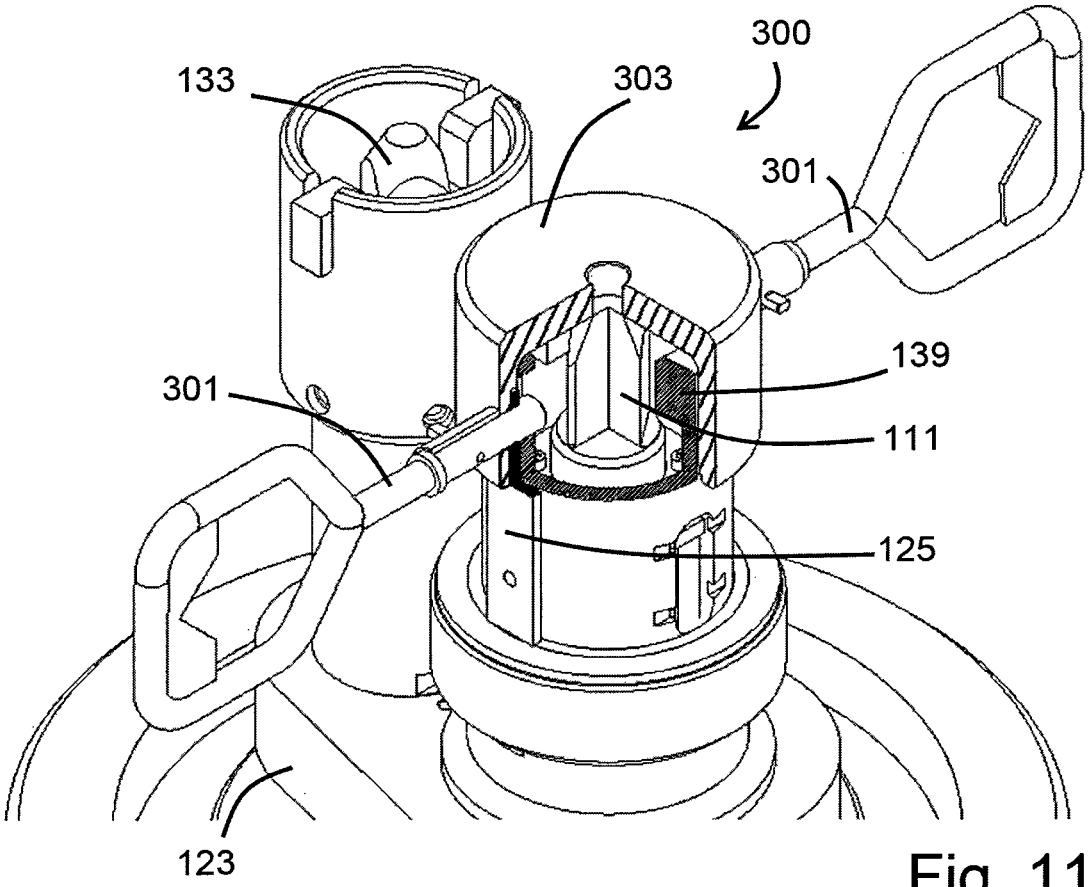
FIG. 11 is a perspective view of the emergency release tool in FIG. 10.

In the following, means and method for an emergency release of the tree cap 100 according to the invention will be described. FIG. 10 and FIG. 11 show the top of the tree cap 100 according to the invention, on which an emergency release tool 300 is arranged. The tree cap 100 comprises an emergency release sleeve 125 (see also FIG. 1) and an tree cap upper body 139. In FIG. 10 and FIG. 11, the emergency release tool 300 is arranged on top of the tree cap. A pair of engagement pins 301 are inserted through respective holes 125*a* in the emergency release sleeve 125, as well as through slots 139*a* in the upper body 139.

The engagement pins 301 are both connected to a release tool cap 303.

Figure 12:
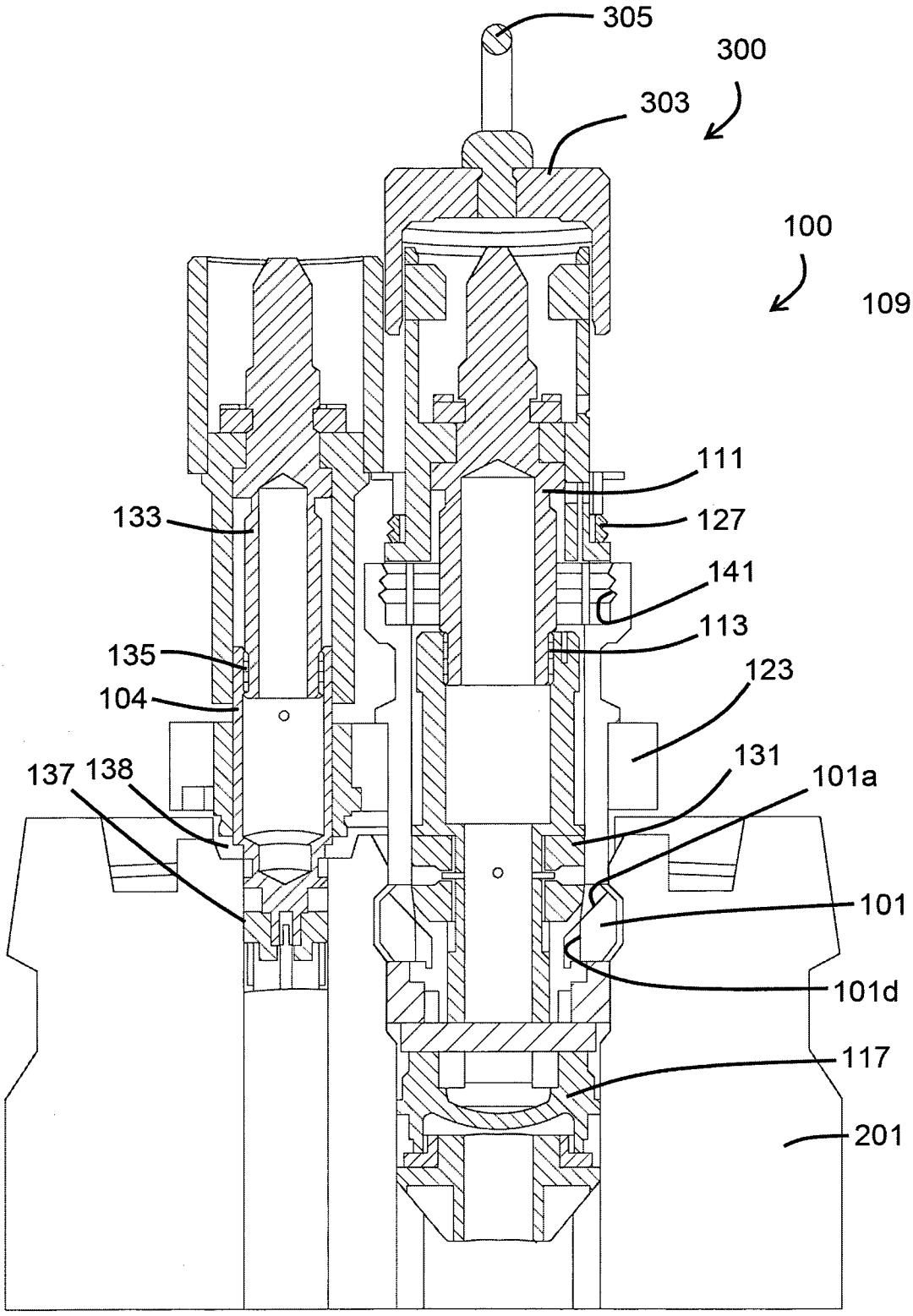
FIG. 12 is a cross section view of the release tool and the tree cap in the process of being pulled out of engagement with the Xmas tree.

It is now also referred to FIG. 12. At the top of the emergency release tool 300, it comprises a hook 305 for pulling of the tool upwards (not shown in FIG. 10 and FIG. 11). By pulling the release tool cap 303, and thus the engagement pins 301 upwards, emergency release sleeve 125 will be pulled upwards. This movement of the emergency release sleeve 125 will make the split ring 127 (FIG. 1 and FIG. 12) move out of engagement with an internal emergency release locking profile 141 of the tree cap 100. This renders the upper body 139, the rotating actuator 111, and thus the actuation sleeve 109 to move upwards with the respect to the locking dogs 101 and the Xmas tree spool 201 without rotation of the rotating actuator 111.

In FIG. 12, the actuation sleeve 109 has been elevated such a distance that the locking dogs 101 are beginning to move radially inwards, thereby releasing the tree cap 100 from the Xmas tree spool 201. This action is performed by pulling in the hook 305 at the top of the emergency release tool 300, after moving the engagement pins 301 into engagement with the emergency release sleeve 125 and the upper body 139. As appreciated by regarding FIG. 1 and FIG. 10, pulling of the hook 305 will first release the emergency release split ring 127, and thereafter move the upper body 139 upwards.

A possible annulus stinger 104 will also be pulled out of the annulus bore, since it is not locked into it, as shown in the embodiment herein.

Thus, if for some reason, the tree cap 100 cannot be released by rotation of the rotating actuator 111, it can be released by installing the emergency release tool 300 onto it, and simply pulling it upwards.

One could also imagine the arrangement of the locking dogs 101, actuation sleeve 109 and cams 131, as described herein, with another means for moving the actuation sleeve in the locking direction. Such means can for instance comprise a hydraulic actuator, as is common in the art and known to a person skilled in the art.

Figure 13:
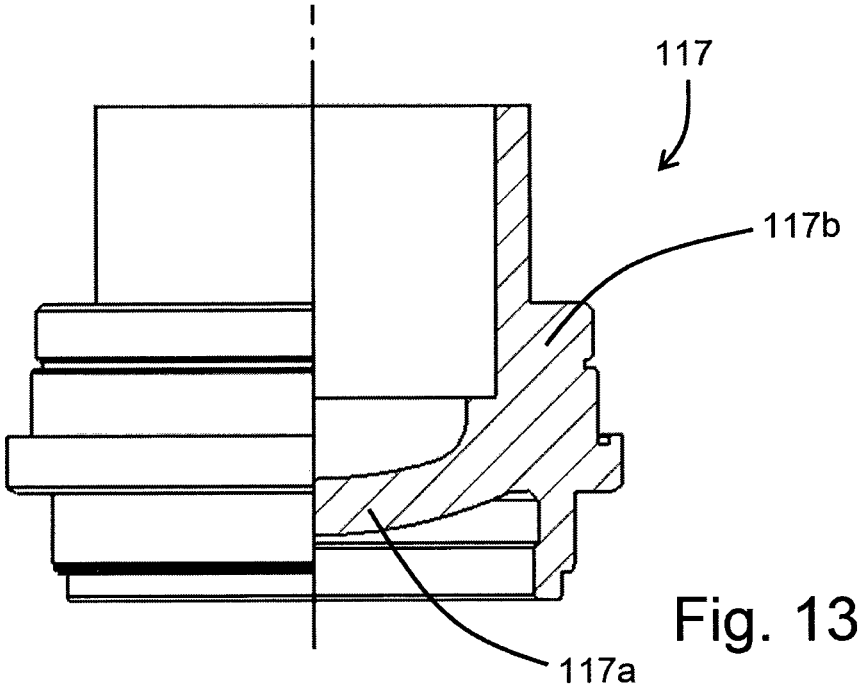
FIG. 13 is a partial cross section view of a seal holder.

It is now referred to FIG. 1 and FIG. 13. In the lower part of the tree cap 100, it exhibits a seal holder 117. According to a particularly preferred embodiment, the seal holder 117 comprises an intermediate section 117*a* which is encircled by a peripheral part 117*b* of the seal holder 117. The seal arrangements 119, 121 are arranged in connection to the peripheral part 117*b*. According to one aspect of the invention, the intermediate section 117*a* of the seal holder 117 is curved with a convex part facing the pressure side of the seal holder 117. Thus, when exposed to a pressure in the XT bore 203, the intermediate section 117*a* will be slightly bent. Thus bending will cause the peripheral part 117*b* to be forced against the surface of the XT bore 203, thereby enhancing the sealing action of the seal arrangements 119, 121.

A person skilled in the art will appreciate that the advantages of the seal holder 117 will exist also with other arrangements where a bore shall be sealed.

The invention claimed is:

1. A cap comprising:

a stinger adapted to be inserted into a bore of a subsea well element, said stinger comprising a plurality of locking dogs for locking to an internal profile in said bore;

wherein the plurality of locking dogs comprise a large inclination face and a small inclination face and are adapted to be actuated in a radial direction by an actuation sleeve;

wherein the small inclination face is divided by a slot, wherein the large inclination face is arranged in said slot;

wherein a cam arranged on the actuation sleeve is adapted to extend into said slot; or the small inclination face is divided by said cam arranged on the plurality of locking dogs, on which the large inclination face is arranged, wherein said cam is adapted to extend into a slot in the actuation sleeve.

2. The cap according to claim 1, wherein a seal arrangement is directly or indirectly connected to the actuation sleeve, in a position adapted to extend further into said bore than the plurality of locking dogs.

3. The cap according to claim 1, wherein the cap is adapted to move the actuation sleeve in three moving phases, in which a first phase comprises moving the locking dogs by engagement with the large inclination faces;

a second phase comprises moving the seal arrangement into a region of a seal surface in said bore; and a third phase comprises forcing the locking dogs in a further radial direction by engagement with the small inclination face;

wherein the second phase succeeds the first phase; and the third phase succeeds the second phase or the third phase takes place simultaneously as the second phase.

4. The cap according to claim 1, wherein the cap comprises a production bore stinger and an annulus bore stinger, of which two stingers only the production bore stinger is provided with the locking dogs.

5. The cap according to claim 1, wherein the cap comprises an emergency release sleeve arranged in a position to maintain an emergency release locking arrangement in a locking position, wherein the emergency release sleeve is adapted to be pulled out of said position, and that when pulled out of said position, the locking dogs can be released from locking engagement with said internal profile by pulling the cap.

6. The cap according to claim 1, wherein the cap comprises a seal holder, which seal holder exhibits an intermediate section with a convex shape towards a pressure side, encircled by a peripheral part arranged for carrying a seal arrangement for sealing against a seal surface in the bore, wherein the intermediate section is adapted to exert radial force onto the peripheral part when exposed to pressure on its convex side.

* * * * *